US009895595B2

(12) United States Patent
Sæteren

(10) Patent No.: US 9,895,595 B2
(45) Date of Patent: Feb. 20, 2018

(54) SKI GRIPPERS

(71) Applicant: Mikal Sæteren, Oppdal (NO)

(72) Inventor: Mikal Sæteren, Oppdal (NO)

( * ) Notice: Subject to any disclaimer, the term of this patent is extended or adjusted under 35 U.S.C. 154(b) by 0 days.

(21) Appl. No.: 15/300,827

(22) PCT Filed: Mar. 31, 2015

(86) PCT No.: PCT/NO2015/050061

§ 371 (c)(1),
(2) Date: Sep. 30, 2016

(87) PCT Pub. No.: WO2015/152731

PCT Pub. Date: Oct. 8, 2015

(65) Prior Publication Data

US 2017/0014708 A1 Jan. 19, 2017

(30) Foreign Application Priority Data

Apr. 4, 2014 (NO) ..... 20140443
Sep. 16, 2014 (NO) ..... 20141120

(51) Int. Cl.

| | |
|---|---|
| ***A63C 7/02*** | (2006.01) |
| ***A63C 7/04*** | (2006.01) |
| ***A63C 5/044*** | (2006.01) |
| ***A63C 5/048*** | (2006.01) |

(52) U.S. Cl.

CPC ..... *A63C 7/02* (2013.01); *A63C 5/044* (2013.01); *A63C 5/0485* (2013.01); *A63C 7/04* (2013.01)

(58) Field of Classification Search

CPC .. A63C 7/02; A63C 5/00; A63C 5/044; A63C 5/06; A63C 5/04; A63C 5/0485; A63C 5/048

See application file for complete search history.

(56) References Cited

U.S. PATENT DOCUMENTS 2,410,702 A * 11/1946 Arsenault ..... A63C 13/001 280/603
3,063,728 A * 11/1962 Patterson ..... A63C 5/0485 280/608
3,980,312 A * 9/1976 Buttner ..... A63C 5/04 280/604

(Continued)

FOREIGN PATENT DOCUMENTS

CH 644276 A5 7/1984
EP 2295120 A1 3/2011

(Continued)

*Primary Examiner* — Hau V Phan

(74) *Attorney, Agent, or Firm* — Ming Chow; Sinorica, LLC

(57) ABSTRACT

A ski gripping system has a ski, a gripping strip and a piece of skins. The gripping strip is mounted longitudinally and laterally to an outer side of the ski along a center portion/grip zone of the ski. A width of the gripping strip is from 17 mm to 60 mm, a height of the gripping strip is from 15 mm to 25 mm, and a length of the gripping strip is from 600 mm to 800 mm. A longitudinal bottom inner edge of the gripping strip is level with an underside of the ski. An underside of the gripping strip is laterally outward sloping 5 degrees upward relative to the underside of the ski. The piece of skins is attached to the underside of the gripping strip.

3 Claims, 1 Drawing Sheet

(56) References Cited

U.S. PATENT DOCUMENTS

| | | | | | |
|---|---|---|---|---|---|
| 6,062,585 | A * | 5/2000 | Hess | A63C 5/048 | 280/608 |
| 6,079,746 | A * | 6/2000 | Olsen | A63C 5/00 | 280/609 |
| 6,264,215 | B1 * | 7/2001 | Carlson | A63C 5/06 | 280/14.21 |
| 7,445,227 | B2 * | 11/2008 | Harris, Jr. | A63C 5/0417 | 280/604 |

FOREIGN PATENT DOCUMENTS

| | | | |
|---|---|---|---|
| EP | 2596839 | A1 | 5/2013 |
| JP | 07108078 | A | 4/1995 |
| NO | 147503 | B1 | 1/1983 |
| NO | 309928 | B1 | 4/2001 |

* cited by examiner

[ Replacement Sheet ]

SKI GRIPPERS

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

TECHNICAL FIELD

The present application relates to gripping strips for skis.

BACKGROUND OF THE INVENTION

WO 99/04870 describes an expansion of the skis' width and length with the help of a "tip shape modifier" and a "tail shape modifier". These parts are being mounted to the skis in front of and behind the binding respectively, and thus make the skis better suited for downhill skiing in deep powder snow. The two parts are each divided into several sections, which are being attached to each other and to the skis. These can be taken on and off the skis according to changing conditions, and be carried in a backpack. This may not be a bad idea, but it seems after all to be somewhat complex and cumbersome in use. And the ski edges have to be completely straight, without any side cut where the sections are to be threaded onto the skis lengthwise.

NO 309928 has the gripping surface as a part of the actual ski. It goes along the most of the outer side of the ski base/sliding surface, and constitutes about ¼ of the ski width. The gripping surface is elevated and parallel to the sliding surface, and is equipped with skins or other gripping agents. So to get grip, also here stepping a bit over onto the outer side of the foot is required. An advantage with this solution compared to my own, is that nothing is added to the skis' weight or width, and they retain their suitability for ski tracks. And the bottom outer edges of the skis will still be useable for breaking or swinging. But for good reasons, the gripping surface is here parallel to, and not oblique to the sliding surface. A result of this should be that the grip in hard and icy conditions will hardly be so good, because only the outermost part of the gripping surface should then be in contact with the substrate. To avoid losing too much of the ski's support surface, the gripping surface can not constitute more than about ¼ of the ski width, which makes the possibility of a quite large gripping surface with much grip rather limited. And the skis have to be reworked, which can be quite inconvenient as well as its adding much cost to the skis. For no major ski producers have been willing to produce these skis, and the ski reworking is a one-man enterprise on the inventor's home place.

BRIEF SUMMARY OF THE INVENTION

On a pair of skis, a strip is mounted longitudinally to the outer side of each ski along the ski's center portion, with a piece of skins attached to the strip's slightly sloping underside, in order to give an optimal grip as well as an optimal glide to the ski. The strips/Ski Grippers give a better grip than most waxed as well as waxless skis, and no grip wax or other grip agents underneath the skis will reduce the glide. The Ski Grippers are meant fairly easily to be taken on and off the skis, and the same pair can be used on more than one pair of skis. No modification of the skis is required, and Ski Grippers can be used with all sorts of cross country skis.

Figure 1:
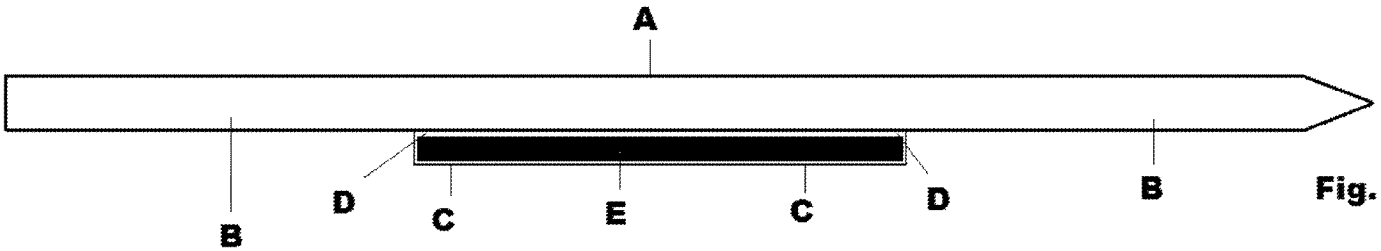
FIG. 1 is a line drawings of a ski and ski gripper/strip as seen from below according to the invention.
Figure 2:
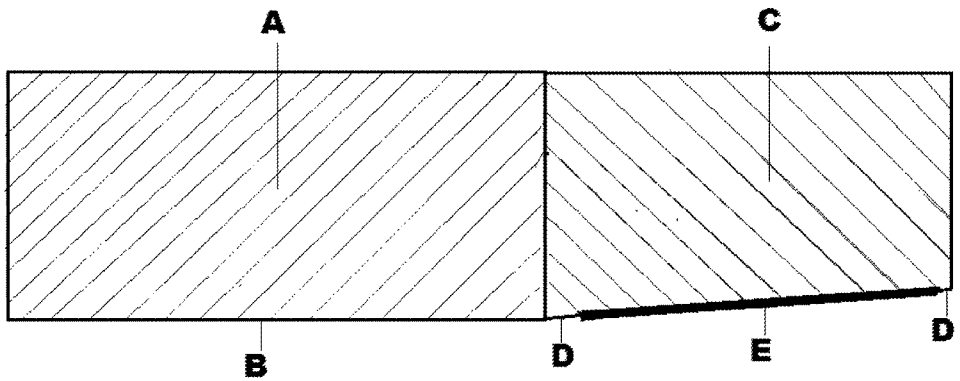
FIG. 2 is a cross section of the ski and Ski Gripper/strip shown in FIG. 1 at the ski midpoint.

A: Ski
B: Ski's underside/sliding surface
C: Ski Gripper/strip
D: Underside of Ski Gripper/strip
E: Skins/gripping surface

DETAILED DESCRIPTION OF THE INVENTION

Ski Grippers, or gripping strips for skis, is a device initially meant to replace grip waxing of skis, which at times can be quite problematic and time consuming. And the problem of wearing the grip wax off the skis in hard and icy conditions is being eliminated. But Ski Grippers can also replace so-called waxless skis, and use of skins for mountain and touring skis.

On a pair of skis, a strip (C) of wood or another material is mounted longitudinally and laterally to the outer side of each ski (A) along the ski center portion/grip zone. To secure continuous contact with the substrate throughout its length, the strip must be mounted with at least 3 attachment points, one at the strip's midpoint and one at each strip end. The strip should be mounted tightly to the ski (A), to avoid snow or anything to wedge in between.

The ski's and the strip's abutting bottom edges may be smooth high, or the strip's edge slightly higher, to be sure that the strip's edge will not cut into the substrate in the sliding phase. The strip's width can span from 17 mm (adapted to ski tracks for the narrowest skis), and up to about 60 mm, depending on ski width and on how much grip which is desired. The strip's height can be from about 15 mm to about 25 mm, dependent on ski thickness, and the length from about 600 to about 800 mm, dependent on ski length. The strip's underside (D) is, laterally from inner to outer edge, sloping about 5 degrees upward relative to the ski's underside (A), which underside constitutes the sliding surface (B). The strip's underside (D) has an interleaving covering most of it's surface, with a depth of about 2 mm, into which interleaving a piece of skins fits and is attached, which skins constitutes the gripping surface (E). The inner edge of the gripping surface (E) will then go about 5 mm from the outer edge of the sliding surface (A), and the anterior, outer, and rear edges of the gripping surface (E) will go about 2 mm from the respective adjacent bottom edges of the strip.

Due to the described angle between the sliding surface (B) and the gripping surface (E), only the gripping surface (E) will be in contact with and rest on the substrate to give optimal grip, when this side is laid flat on the substrate. When the sliding surface is laid flat on the substrate, only this side will be in contact with and rest on the substrate to give optimal glide, due to the described distance as well as to the angle between the two surfaces. Hence in order to get grip, stepping a bit over onto the outer side of the foot is required, which is easier than stepping over the opposite way. And with the Ski Grippers mounted on the outer side of the skis, the skis' inner bottom edges are retained for plow breaking in downhills. The skis' outer bottom edges will of course not be suitable for breaking or swinging, unless the Ski Grippers are taken off the skis. In looser snow conditions, the ski will of course more or less sink down, so that the gripping surface will come in contact with the substrate in the sliding phase, and reduce the glide a bit. So a separate part, not included in this application, a short front end with a tip, is intended to be used with the Ski Grippers, to "clear trail" for the gripping surface.

The invention claimed is:

1. A ski gripping system comprising:

a ski;

a gripping strip;

a piece of skins;

the gripping strip being mounted longitudinally and laterally to an outer side of the ski along a center portion/grip zone of the ski;

a width of the gripping strip being from 17 mm to 60 mm;

a height of the gripping strip being from 15 mm to 25 mm;

a length of the gripping strip being from 600 mm to 800 mm;

a longitudinal bottom inner edge of the gripping strip being level with an underside of the ski;

an underside of the gripping strip being laterally outward sloping 5 degrees upward relative to the underside of the ski; and the piece of skins being attached to the underside of the gripping strip.

2. The ski gripping system according to claim 1 comprising:

the underside of the gripping strip having an 2 mm deep interleaving covering most of its surface;

a longitudinal inner edge of the interleaving going 5 mm from an outer edge of the underside of the ski; and the underside of the ski constituting a sliding surface.

3. The ski gripping system according to claim 2 comprising:

the piece of skins fitting in and being attached into the interleaving on the underside of the gripping strip; and the piece of skins constituting a gripping surface.

* * * * *